US010634467B2

(12) United States Patent
Kim et al.

(10) Patent No.: US 10,634,467 B2
(45) Date of Patent: Apr. 28, 2020

(54) INITIATOR FOR ROCKET MOTOR

(71) Applicants: Dongseong Kim, Cheongju-si (KR); Seunggyo Jang, Daejeon (KR); Moonho Lee, Daejeon (KR)

(72) Inventors: Dongseong Kim, Cheongju-si (KR); Seunggyo Jang, Daejeon (KR); Moonho Lee, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 15/712,862

(22) Filed: Sep. 22, 2017

(65) Prior Publication Data

US 2018/0299235 A1 Oct. 18, 2018

(30) Foreign Application Priority Data

Apr. 13, 2017 (KR) ..... 10-2017-0048096

(51) Int. Cl.
*F42B 3/12* (2006.01)

(52) U.S. Cl.
CPC ..... *F42B 3/124* (2013.01)

(58) Field of Classification Search
CPC .. F42B 3/103; F42B 3/12; F42B 3/124; F42B 3/13; F42C 19/02; F42C 19/0819; F42C 19/12
USPC ..... 102/202, 202.5, 202.7, 202.9, 202.14
See application file for complete search history.

(56) References Cited

U.S. PATENT DOCUMENTS 2,802,422 A * 8/1957 Horne ..... F42B 3/18 102/202.11
3,134,329 A * 5/1964 Zeman ..... F42B 3/103 102/202.7
3,945,322 A * 3/1976 Carlson ..... F42D 1/04 102/275.4
4,103,619 A * 8/1978 Fletcher ..... F42B 3/185 102/202.5
4,316,412 A * 2/1982 Dinegar ..... F42B 3/103 102/202.5
4,735,145 A * 4/1988 Johnson ..... F42C 19/0815 102/202.14

(Continued)

OTHER PUBLICATIONS

Korean Office Action dated Jun. 12, 2017 issued in KR 10-2017-0048096.

(Continued)

*Primary Examiner* — Stephen Johnson
*Assistant Examiner* — Benjamin S Gomberg
(74) *Attorney, Agent, or Firm* — Scully, Scott, Murphy & Presser, P.C.

(57) ABSTRACT

Provided is an initiator for a rocket motor. The initiator for a rocket motor includes: a sleeve assembly configured to form a hollow portion; and an ignition assembly including a plug portion mounted on the sleeve assembly to close one side of the hollow portion and configured to deliver an electrical signal and a foil ignition portion coupled to the inside of the plug portion to be adjacent to the hollow portion. The sleeve assembly includes: a first gunpowder accommodated in the hollow portion to be adjacent to the foil ignition portion and detonated by the foil ignition portion; and a second gunpowder accommodated inside the hollow portion to contact the first gunpowder and deflagrated or combusted by the detonation of the first gunpowder.

3 Claims, 3 Drawing Sheets

(56) References Cited

U.S. PATENT DOCUMENTS

| | | | | |
|---|---|---|---|---|
| 5,204,491 | A * | 4/1993 | Aureal | F42B 3/124 102/202.14 |
| 5,831,203 | A * | 11/1998 | Ewick | F42B 3/10 102/202.5 |
| 5,932,832 | A * | 8/1999 | Hansen | B60R 21/2644 102/202.2 |
| 6,178,888 | B1 * | 1/2001 | Neyer | F42B 3/124 102/202.14 |
| 7,430,963 | B2 | 10/2008 | Hennings et al. | |
| 7,661,362 | B2 | 2/2010 | Hennings et al. | |
| 8,037,824 | B1 | 10/2011 | Plummer et al. | |
| 8,196,512 | B1 * | 6/2012 | Reynolds | F42B 3/121 102/202.14 |
| 8,205,554 | B2 * | 6/2012 | Fink | F42B 3/103 102/202.14 |
| 8,281,718 | B2 | 10/2012 | Rice | |
| 8,726,808 | B1 * | 5/2014 | Nance | F42B 3/10 102/202.14 |
| 2004/0107856 | A1 | 6/2004 | Hennings et al. | |
| 2007/0119325 | A1 | 5/2007 | Hennings et al. | |
| 2009/0151584 | A1 | 6/2009 | Desai | |
| 2010/0282105 | A1 * | 11/2010 | Neyer | F42B 3/18 102/202.1 |
| 2016/0178333 | A1 | 6/2016 | Biggs et al. | |

OTHER PUBLICATIONS

Decision for Accelerated Examination dated Apr. 14, 2017 issued in KR 10-2017-0048096.

Notice of Allowance dated Sep. 1, 2017 issued in KR 10-2017-0048096.

* cited by examiner

INITIATOR FOR ROCKET MOTOR

CROSS-REFERENCE TO RELATED APPLICATION

Pursuant to 35 U.S.C. § 119(a), this application claims the benefit of earlier filing date and right of priority to Korean Application No. 10-2017-0048096, filed on Apr. 13, 2017, the contents of which is incorporated by reference herein in its entirety.

BACKGROUND OF THE INVENTION

1. Field of the Invention

The present invention relates to an initiator for a rocket motor which is operated by an exploding foil initiator to ignite a rocket motor.

2. Background of the Invention

An exploding foil initiator is also called High Voltage Initiator, and is generally operated at a high voltage of 1000 V or more.

The exploding foil initiator operates in a mechanism in which a metal thin film bridge is vaporized and converted to plasma as voltage is applied, a thin Polyimide film is scattered along with the plasma on a thin film, and explosion occurs when a secondary explosive such as Hexanitrostilbene (HNS)-IV is encountered.

Originally, the exploding foil initiator is designed as a detonator for missile warheads and has the advantage that it can be used directly in connection with a warhead high-explosive without additional safeguards due to the complicated operating conditions (Patent Document 1). In addition, the exploding foil initiator was used as a trigger device for a Cartridge Actuated Device (Patent Document 2). Since the exploding foil initiator is mostly used at the end of the mission, it is used for a detonation using high-explosive such as HNS. Therefore, during the detonation of a general exploding foil initiator, the housing of the initiator is also destroyed, so that the shape before operation may not be maintained.

On the other hand, when the exploding foil initiator is used for igniting a rocket motor, a new design is required to prevent the destruction of the initiator housing by chemical detonation. This is because the initiator used for a rocket motor should withstand the combustion pressure during the combustion of the rocket motor even after the initiator operates. If the initiator housing is destroyed when the exploding foil initiator is operated, the propulsion engine may be ignited but immediately, the combustion gas of the propulsion engine is leaked through the exposed initiator assembly and exposed to high temperature and high pressure, so that immediately the propulsion system will be detonated.

Patent Document 3 discloses an exploding foil initiator designed for use in the igniter of a propulsion engine. Like the existing exploding foil initiator, when a metal thin film is converted to plasma, a polyimide film piece is scattered and collided with a secondary gun powder such as HNS, so that this initiator starts to operate. However, in order to prevent destruction of the initiator housing by detonation such as high-explosive such as HNS, a small amount of high explosive is used and an output charge to supply ignition energy is used separately. At this time, the output charge, as a gunpowder having a characteristic of deflagration or combustion, is combusted during operation to generate gas but prevents damage of the initiator housing structure.

However, the initiator of Patent Document 3 is assembled so that the output charge is contained in the metal case and closely contacted with the explosive in order to initiate the combustion of the output charge due to the explosion pressure and heat generated by a minute high explosive. In addition, an auxiliary reactant is installed between the high explosive and the output powder so that the energy generated when the high explosive is detonated is well delivered to the output charge. In addition, Patent Document 3 discloses a complicated structure in which a terminal for electrically connecting an electrode of an initiator to a metal thin film is mounted.

As described above, the initiator as in the conventional Patent Document 3 is designed to transmit energy through various stages and structures until the final deflagration or combustion. Therefore, if more simplified components and ignition mechanisms are devised, there is room for improvement in reliability of an initiator for a rocket motor in addition to miniaturization.

(Patent Document 1) U.S. Pat. No. 8,281,718 B2 (Registered on 2012 Oct. 9)

(Patent Document 2) U.S. Pat. No. 8,037,824 B1 (registered on 2011 Oct. 18)

(Patent Document 3) U.S. Pat. No. 7,661,362 B2 (registered on 2010 Feb. 16)

SUMMARY OF THE INVENTION

Therefore, an aspect of the detailed description is to provide an initiator for a rocket motor with a simple housing internal structure in which gunpowder for continuous ignition is accommodated.

Another aspect of the detailed description is to provide an initiator for a rocket motor with a structure in which an exploding foil initiator and a plug are connected to each other in a simple manner inside the housing.

To achieve these and other advantages and in accordance with the purpose of this specification, as embodied and broadly described herein, there is provided an initiator for a rocket motor including: a sleeve assembly configured to form a hollow portion; and an ignition assembly including a plug portion mounted on the sleeve assembly to close one side of the hollow portion and configured to deliver an electrical signal and a foil ignition portion coupled to the inside of the plug portion to be adjacent to the hollow portion, wherein the sleeve assembly includes: a first gunpowder accommodated in the hollow portion to be adjacent to the foil ignition portion and detonated by the foil ignition portion; and a second gunpowder accommodated inside the hollow portion to contact the first gunpowder and deflagrated or combusted by the detonation of the first gunpowder.

The plug portion may include: a body portion inserted in the sleeve assembly; and a plurality of pins extending to penetrate the body portion.

An inner end facing the hollow portion of the pin may be formed as a plane cut surface to be adhered to a surface of the foil ignition portion.

An outer end of the pin may be formed to be convex in a spherical shape.

The foil ignition portion may include: an ignition layer including a bridge vaporized by voltage application; an insulating layer disposed on one side of the ignition layer and including a plurality of pin accommodating holes; and a spacing layer disposed on the other side of the ignition layer and including a through hole formed to expose the bridge to the other side.

The plug portion may further include a sealing member interposed between the body portion and the pin to surround the outer circumferential surface of the pin and including a protrusion portion protruding to be accommodated in an accommodating groove recessed at the outer circumferential surface of the pin.

The accommodating groove may extend to surround the outer circumferential surface of the pin, and the protrusion portion may be formed in an annular shape to be accommodated in the accommodating groove.

The sleeve assembly may include: a screw fastening portion screw-coupled to a rocket motor and inserted therein; a fastener coupling portion having a portion of the outer circumferential surface protruded or recessed to engage with a fastening tool for the screw fastening; and a wire accommodating portion formed to penetrate the fastener coupling portion and accommodate a fastening wire connected to the rocket motor.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, an initiator for a rocket motor related to the present invention will be described in detail with reference to the accompanying drawings.

In describing exemplary embodiments disclosed in this specification, a specific description for publicly known technologies will be omitted when it is judged that the description obscures the gist of the embodiments disclosed in the specification.

Also, it should be understood that the accompanying drawings are merely illustrated to easily explain exemplary embodiments disclosed in this specification, and therefore, they should not be construed to limit the technical ideas disclosed in this specification but be construed to cover all modifications and alternatives falling within the spirit and scope of the present invention.

The singular expressions include plural expressions unless the context clearly dictates otherwise.

The initiator for a rocket motor is a device that supplies ignition energy to start combustion of a rocket motor (also referred to as a rocket engine, or a propulsion engine). In particular, an exploding foil initiator for rocket motors is required to maintain the structure to be tightly closed after ignition. Hereinafter, the structure and functions of an initiator for a rocket motor according to the present invention will be described with reference to the drawings.

Figure 1:
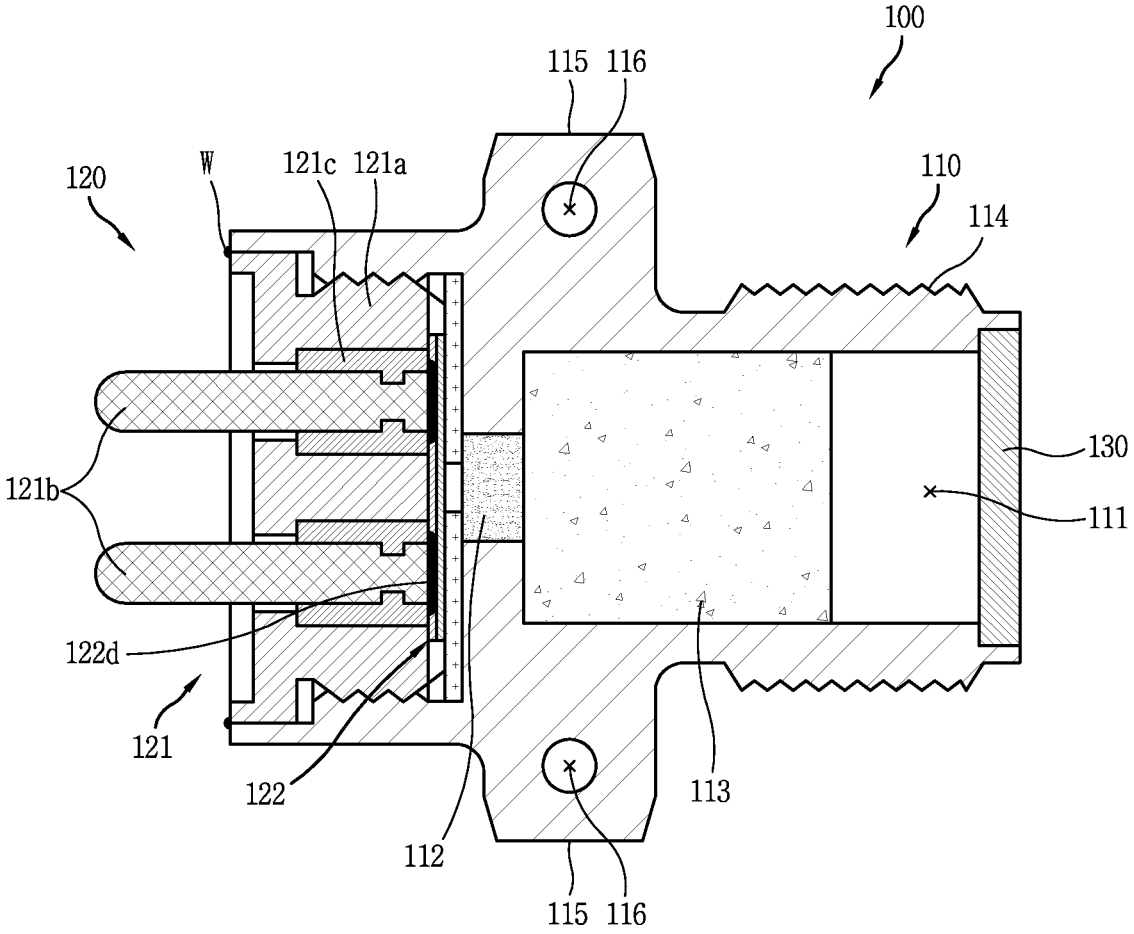
FIG. 1 is a sectional view showing an initiator for a rocket motor according to the present invention.

FIG. 1 is a sectional view showing an initiator for a rocket motor 100 according to the present invention. In addition, FIG. 2 is a sectional view showing a sleeve assembly 110 shown in FIG. 1, and FIG. 3 is a rear view showing the sleeve assembly 110 shown in FIG. 2.

Figure 2:
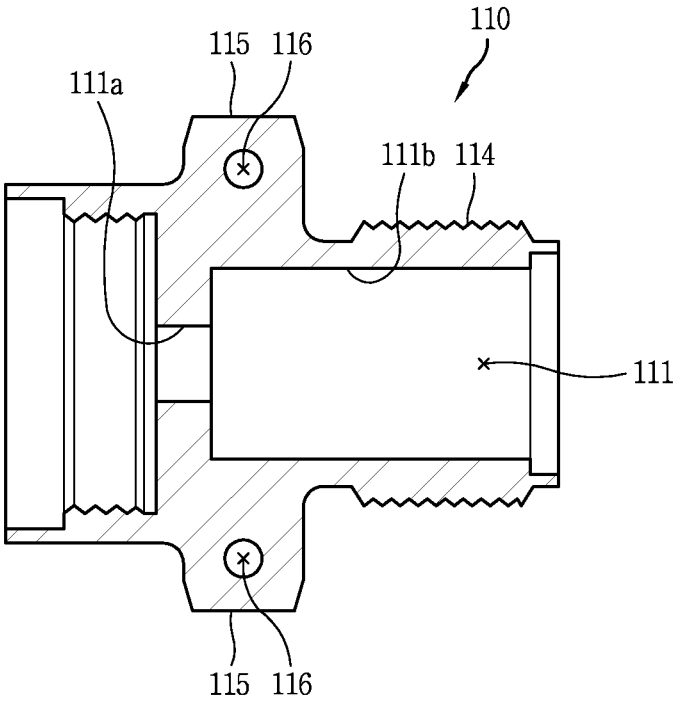
FIG. 2 is a cross-sectional view showing a portion of a sleeve assembly shown in FIG. 1.
Figure 3:
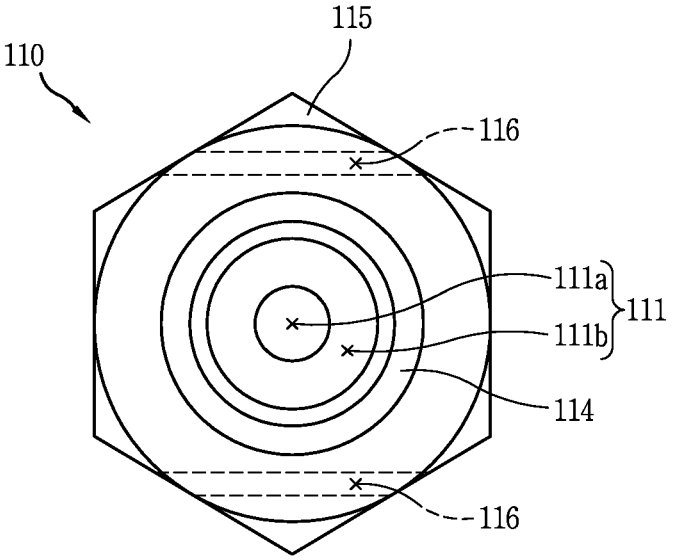
FIG. 3 is a rear view showing a portion of a sleeve assembly shown in FIG. 2.

Referring to FIGS. 1 to 3, the initiator for a rocket motor 100 according to the present invention includes a sleeve assembly 110 and an ignition assembly 120. The sleeve assembly 110 accommodates gunpowder through which energy for ignition is generated and maintains the sealed structure even after the detonation action of the gunpowder. Then, the sleeve assembly 110 serves to receive electrical energy to ignite the gunpowder accommodated in the sleeve assembly 110.

First, the sleeve assembly 110 is configured to form a hollow portion 111. As shown in FIGS. 1 and 2, the sleeve assembly 110 has a cylindrical shape extending in one direction (e.g., the left and right directions in FIGS. 1 and 2). The hollow portion 111 formed in the sleeve assembly 110 may extend in one direction to open both ends and may have a shape in which a plurality of cylindrical spaces are concentrically connected.

Meanwhile, the ignition assembly 120 includes a plug portion 121 and a foil ignition portion 122. The plug portion 121 serves as an electrical connection portion for delivering electrical energy to the initiator for a rocket motor 100 according to the present invention. As shown in FIG. 1, the plug portion 121 is mounted to the sleeve assembly 110 to close one end of the hollow portion 111. Then, the foil ignition portion 122 is mounted on the inner surface of the plug portion 121 and is disposed adjacent to the hollow portion 111.

The foil ignition portion 122 may be a portion operated by the mechanism of an exploding foil initiator in the initiator for a rocket motor 100 according to the present invention. That is, when the foil ignition portion 122 is applied with a high voltage of approximately 1000 V from the plug portion 121, a bridge 122*d* formed for narrowing the cross-sectional area of a wire on the thin film structure may be vaporized and converted to plasma by heat generation. At this time, a polyimide film formed adjacent to the bridge 122*d* is scattered together, so that the ignition action may be performed. Specific features of the foil ignition portion 122 of the present invention will be described later.

In the initiator for a rocket motor 100 according to the present invention, the sleeve assembly 110 includes first gunpowder 112 and second gunpowder 113, and they are installed adjacent to each other, so that a simple structure may be realized.

The first gunpowder 112 is accommodated in the hollow portion 111 to be adjacent the foil ignition portion 122. As shown in FIG. 1, the first gunpowder 112 may be accommodated in a first hollow 111*a* having a relatively small inner diameter and a cylindrical space adjacent to the foil ignition portion 122 in the hollow portion 111.

The first gunpowder 112 may be made of a high explosive such as Hexanitrostilbene (HNS)-IV and may be detonated by a piece of polyimide film scattered with plasma. This first gunpowder 112 may be set to an amount that prevents structural damage to the sleeve assembly 110 at the time of detonation.

The second gunpowder 113 is accommodated in the hollow portion 111 so as to contact the first gunpowder 112. As shown in FIG. 1, the second gunpowder may be filled in a second hollow 111*b*, which is a cylindrical space with a relatively larger inner diameter than the first hollow 111*a* and adjacent to the first hollow 111*a* in the hollow portion 111.

The second gunpowder 113 may be made of, for example, $BKNO_3$. The second gunpowder 113 is deflagrated or combusted by detonation of the first gunpowder 112. In particular, since the energy due to the detonation of the first gunpowder 112 is directly accommodated and reaction occurs, the ignition energy may be supplied to a rocket motor.

On the other hand, the other end of the hollow portion 111 may be closed by a sleeve cap 130. The sleeve cap 130 may be welded to the sleeve assembly 110 to seal the hollow portion 111. In particular, the sleeve cap 130 seals the second gunpowder 113 filled in the second hollow 111*b* from the outside, thereby preventing performance deterioration due to moisture infiltration. The airtightness inside the hollow portion 111 by the sleeve cap 130 may be provided to maintain $10^{-6}$ He/cc.

As the first gunpowder 112 and the second gunpowder 113 may be formed to be in contact with each other, the initiator for a rocket motor 100 according to the present invention may be simply configured with the hollow portion 111 where the structure of the sleeve assembly 110 communicates with one space. Further, it is not necessary to separately provide a structure such as a metal case for separating the first gunpowder 112 and the second gunpowder 113 from each other. Therefore, the present invention may be configured concisely with a small number of parts, so that assembly convenience can be improved. Furthermore, there is an advantage that a smaller size initiator can be manufactured easily.

On the other hand, in relation to the present invention in which a separate case structure is omitted, the amounts of the first gunpowder 112 and the second gunpowder 113 need to be appropriately designed in consideration of interaction therebetween. Specifically, if the amount of first gunpowder 112 is greater than necessary, there is a risk that the structure of the sleeve assembly 110 will be damaged due to its detonation force. Conversely, if the amount of the first gunpowder 112 is excessively small, the second gunpowder 113 may not sufficiently provide reaction, so that the ignition energy is not sufficiently supplied to the rocket motor.

Therefore, as the first gunpowder 112 and and the second gunpowder 113 of the present invention, the sleeve assembly 110 of the present invention may be filled with 5 mg to 15 mg of the first gunpowder 112 made of HNS and 100 mg to 200 mg of the second gunpowder 113 made of $BKNO_3$. That is, the first gunpowder 112 may be accommodated in the sleeve assembly 110 of the present invention to have a value of 2.5% to 15% of the mass of the second gunpowder 113.

As described above, since the mass of each of the first gunpowder 112 and the second gunpowder 113 has an optimum design value, the sealing of the sleeve assembly 110 of the present invention may be maintained even after ignition and sufficient ignition energy may be supplied to the rocket motor.

In the above, in relation to the initiator for a rocket motor 100 according to the present invention, structural features in which the first gunpowder 112 and the second gunpowder 113 are accommodated in the sleeve assembly 110 are described. Structural features of the ignition assembly 120 of the initiator for a rocket motor 100 according to the present invention will be described below with reference to FIGS. 4 and 5.

Figure 4:
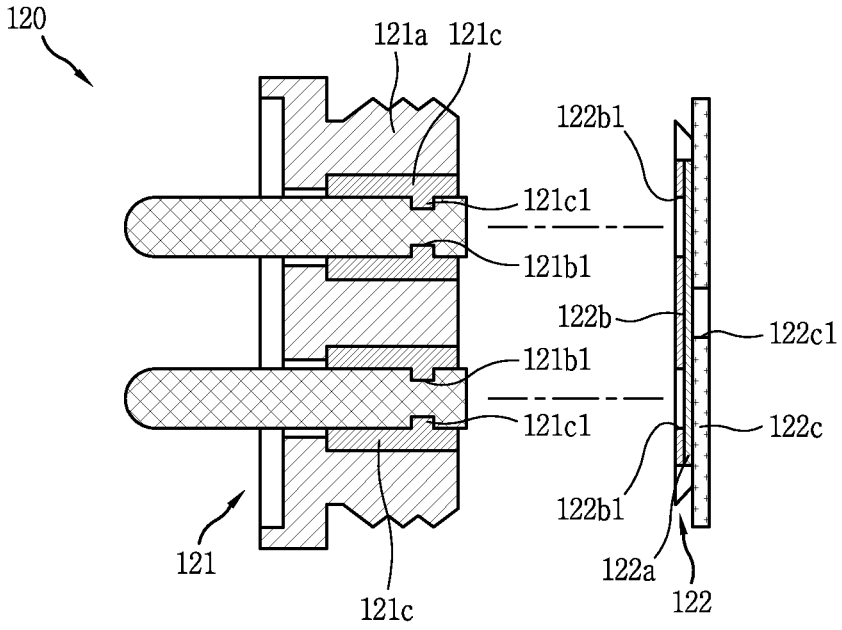
FIG. 4 is a cross-sectional view showing an ignition assembly shown in FIG. 1.
Figure 5:
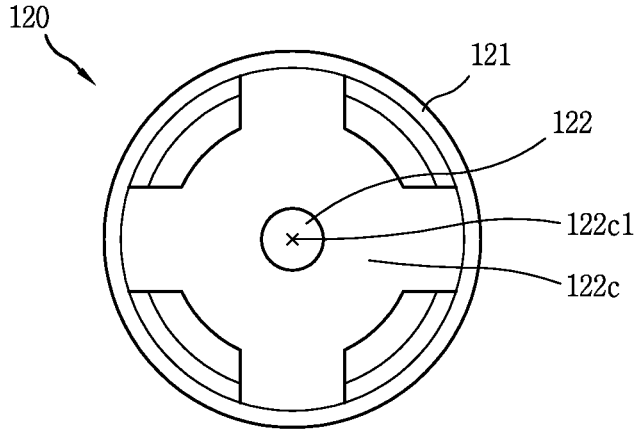
FIG. 5 is a rear view showing an ignition assembly shown in FIG. 4.

FIG. 4 is a sectional view showing the ignition assembly 120 shown in FIG. 1, and FIG. 5 is a rear view showing the ignition assembly 120 shown in FIG. 4. As mentioned above, the ignition assembly 120 includes a plug portion 121 and a foil ignition portion 122. The plug portion 121 may include a plug body 121*a* configured to be inserted into the sleeve assembly 110 and a plurality of pins 121*b* extending through the plug body 121*a*.

The plug body 121*a* may be screw-coupled to a portion of the inner circumferential surface of the hollow portion 111 to seal one side of the hollow portion 111. In addition, after being screw-coupled, the plug body 121*a* and the sleeve assembly 110 are welded together to ensure additional sealing. Specifically, the outer circumferential surface end of the plug body 121*a* shown in FIG. 1 and the inner circumferential surface end of the hollow portion 111 in contact therewith may be welded (w) to each other in order for sealing.

The pin 121*b* shown in FIGS. 1 and 4 is a configuration for applying voltage to the foil ignition portion 122. The pin 121*b* is a structure constituting an electrode, and two pins 121*b* may be arranged in parallel so as to pass through the plug body 121*a*.

Particularly, the initiator for a rocket motor 100 according to the present invention is characterized in that the foil ignition portion 122 and the pin 121*b* are bonded to each other through adhesion. To this end, one end (the right end in FIGS. 1 and 4) of the pin 121*b* inserted toward the hollow portion 111 may be a plane cut surface. An adhesive material such as a conductive epoxy may be applied to the cut surface of the plane formed on the pin 121*b* and may be fixed as so to apply an electric current to an electric circuit formed on one surface of the foil ignition portion 122.

In addition, the other end (the left end of FIGS. 1 and 4) of the pin 121*b* inserted into the hollow portion 111 may have a convex spherical shape. Such a shape may contribute to improvement in convenience when a socket for supplying an electric signal to the plurality of pins 121*b* is assembled.

Moreover, in particular, as shown in FIG. 4, the foil ignition portion 122 may include an ignition layer 122*a*, an insulating layer 122*b*, and a spacing layer 122*c*. The ignition layer 122*a* serves to detonate the first gunpowder 112 by the mechanism of the exploding foil initiator described above. The ignition layer 122*a* may include a bridge 122*d* layer (not shown) made of a conductive material and a polyimide layer scattered when the bridge 122*d* is converted to plasma. In the ignition layer 122*a*, the plane cut surface of the pin 121*b* described above may be attached so as to directly apply an electric current to the bridge 122*d*. The insulating layer 122*b* may be formed to cover one side of the ignition layer 122*a*. However, a plurality of pin accommodating holes 122*b*1 may be formed in the insulating layer 122*b* so as to realize contact between the ignition layer 122*a* and the pin 121*b*. In particular, the pin accommodating hole 122*b*1 may be utilized as an alignment reference when the foil ignition portion 122 and the plug portion 121 are assembled.

The spacing layer 122*c* may be formed to cover the other side of the ignition layer 122*a*. However, a through hole 122*c*1 may be formed in the center of the spacing layer 122*c* in order to allow a material such as polyimide, which is scattered on the ignition layer 122*a* and detonates the first gunpowder 112, to penetrate. In addition, the spacing layer 122*c* is formed to have a predetermined thickness, and serves to secure a separation distance between the ignition layer 122*a* and the first gunpowder 112. That is, the thickness of the spacing layer 122*c* may be designed as a distance such that the polyimide of the ignition layer 122*a* can be accelerated sufficiently to detonate the first gunpowder 112.

In addition, the spacing layer 122*c* may serve to physically support and protects the ignition layer 122*a* that can be made of a thin film of copper.

According to the above-described coupling structure, a separate terminal component added to connect the connector and the initiator may be omitted from the initiator for a rocket motor 100 of the present invention. Therefore, miniaturization according to the reduction of the internal space may be possible, and the assembly process may be simplified.

On the other hand, the plug portion 121 forming the ignition assembly 120 of the present invention may further include a sealing member 121*c*. Hereinafter, the sealing member 121*c* serving to perform insulation and sealing between the pin 121*b* and the plug body 121*a* will be described with reference to FIGS. 1 and 4.

The sealing member 121*c* may be formed in a cylindrical shape surrounding the outer circumferential surface of the pin 121*b*. Then, the outer circumferential surface of the sealing member 121*c* may be contacted and fixed to the inner circumferential surface of the hole formed in the plug body 121*a* so as to allow the pin 121*b* to penetrate.

Further, the sealing member 121*c* may have a protrusion portion 121*c*1 to maintain a firm coupling with the pin 121*b*. The protrusion portion 121*c*1 may have a shape protruding from the inner circumferential surface of the sealing member 121*c* and an accommodating groove 121*b*1 for accommodating the protrusion portion 121*c*1 may be formed on the outer circumferential surface of the pin 121*b*. The protrusion portion 121*c*1 and the accommodating groove 121*b*1 may extend annularly along the circumferential direction of the pin 121*b*.

The sealing member 121*c* may be made of an insulating glass material for electrical insulation. Then, a plurality of beads made of insulating glass are heated and melted while being inserted into the accommodating groove 121*b*1 so that an annular protrusion portion 121*c*1 is formed and integrally formed with the cylindrical sealing member 121*c*.

In such a manner, by mounting the sealing member 121*c* having the protrusion portion 121*c*1, it is possible to ensure the air tightness of the combustion chamber after the ignition in addition to the accurate transmission of the electric signal. Particularly, since the sealing member 121*c* having the protrusion portion 121*c*1 is integrally formed, the structural sealing may be effectively implemented without a separate coupling member for coupling with the pin 121*b*. In addition, insulation breakage by separate fastening parts may be resolved.

The initiator for a rocket motor 100 according to the present invention is coupled to a rocket motor and operates in a state where the assembly is completed. During the detonation of the first gunpowder 112 and the deflagration and combustion process of the second gunpowder 113, the coupling between the sleeve assembly 110 and the rocket motor should be firmly maintained in the initiator for a rocket motor 100 according to the present invention, so that leakage of high temperature and high pressure gas to the initiator for a rocket motor 100 of the present invention can be prevented.

First, the sleeve assembly 110 of the present invention may be fixed to the rocket motor by a screw fastening portion 114 formed on the outer circumferential surface. In detail, the sleeve assembly 110 can be inserted such that the side (i.e., the right side in FIG. 1) on which the sleeve cap 130 is mounted is adjacent to the inside of the rocket motor.

A fastener coupling portion 115 may be formed on the outer circumferential surface of the sleeve assembly 110 to implement assembling easily through screw fastening. As shown in FIG. 3, the fastener coupling portion 115 may be formed to have a hexagonal outer surface, and a nut fastening tool or the like may be fixed, so that torque for screw fastening can be effectively applied.

Further, for secondary fixing of the sleeve assembly 110 and the rocket motor, the sleeve assembly 110 of the present invention may include a wire accommodating portion 116. As shown in FIGS. 2 and 3, the wire accommodating portion 116 may be formed of at least one hole penetrating the fastener coupling portion 115 in one direction.

After the sleeve assembly 110 and the rocket motor are coupled to each other through the fastening screw portion, a lock wire may be inserted into the wire accommodating portion 116 to perform secondary fixing. Like the wire accommodating portion 116, a structure capable of accommodating or fixing the lock wire may be formed at the rocket motor.

As the wire accommodating portion 116, i.e., a secondary fastening means, is provided, even if vibration or shock occurs during rocket transportation or shock occurs during combustion of the initiator for a rocket motor 100 or the rocket motor of the present invention, the sealing maintenance of the present invention may be ensured.

According to the present invention constituted by the solution means described above, there are the following effects.

First, in relation to the initiator for a racket motor according to the present invention, as the first gunpowder detonated by the foil ignition portion and the second gunpowder combusted by the first gunpowder are formed to contact each other, the internal structure of a sleeve may be simplified and the number of parts may be reduced, thereby improving the reliability. In addition, by a simple structure, manufacturing convenience may be increased and miniaturization may be easily realized.

Secondly, since the initiator for a rocket motor according to the present invention is formed such that a pin for voltage application is directly bonded to the surface of the foil ignition portion, a separate connecting component may be omitted. Therefore, miniaturization according to the reduction of the internal space may be possible, and the assembly process may be simplified.

Meanwhile, in relation to the initiator for a rocket motor according to the present invention, by a sealing member having the protrusion portion in the form of being inserted into the pin for electrical connection, the air tightness of the combustion chamber after ignition may be ensured.

On the other hand, as the sleeve assembly of the present invention is configured such that a wire is accommodated and fastened to a rocket motor, it is possible to prevent the weakening of the engagement of the initiator for a rocket motor and the rocket motor according to the present invention in multiple ways.

The above-described embodiments are merely examples for implementing an initiator for a rocket motor according to the present invention and the present invention is not limited to the above embodiments. It will be understood by those of ordinary skill in the art that various changes are possible therein without departing from the spirit and scope of the invention as defined by the appended claims.

What is claimed is:

1. An initiator for a rocket motor comprising:

a sleeve assembly including a hollow portion; and an ignition assembly including a plug portion and a foil ignition portion, wherein the plug portion is mounted on the sleeve assembly to close one side of the hollow portion and is configured to deliver an electrical signal to the ignition portion, wherein the foil ignition portion is coupled to inside of the plug portion and is disposed adjacent to the hollow portion, wherein the sleeve assembly comprises:

a first explosive charge accommodated in the hollow portion and disposed adjacent to the foil ignition portion and configured to be detonated by the foil ignition portion; and a second explosive charge accommodated inside the hollow portion to contact the first explosive charge and configured to be deflagrated or combusted by the detonation of the first explosive charge, wherein the plug portion comprises:

a body portion inserted in the sleeve assembly;

a plurality of pins extending into the body portion; and a sealing member interposed between the body portion and each of the plurality of pins to surround an outer circumferential surface of each of the plurality of pins, wherein the plurality of pins include accommodating grooves which are recessed at the outer circumferential surface of each of the plurality of pins, and wherein the seating member includes a protrusion portion which protrudes into the accommodating grooves, wherein each of the plurality of pins comprise an inner end facing the hollow portion, and wherein the inner end of the pin is formed as a plane cut surface configured to be adhered to a surface of the foil ignition portion, wherein the foil ignition portion comprises:

an ignition layer including a bridge configured to be vaporized by applying a voltage thereto;

an insulating layer disposed on one side of the ignition layer and including a plurality of pin accommodating holes; and a spacing layer disposed on the other side of the ignition layer and including a through hole formed to expose the bridge to the first explosive charge, and wherein the first explosive is accommodated in a first hollow having a small inner diameter and a cylindrical space adjacent to the foil ignition portion in the hollow portion, and the second explosive is filled in a second hollow which is a cylindrical space with a larger inner diameter than the first hollow and adjacent to the first hollow in the hollow portion.

2. The initiator of claim 1, wherein an outer end of each of the plurality of pins is convex.

3. The initiator of claim 1, wherein the accommodating grooves surround the outer circumferential surface of each of the plurality of pins, and the protrusion portion is annular to be accommodated in the accommodating grooves.

* * * * *